US007117626B1

(12) United States Patent
Alzamora et al.

(10) Patent No.: US 7,117,626 B1
(45) Date of Patent: Oct. 10, 2006

(54) MAGAZINE FEED LIPS GAUGE

(75) Inventors: Ronny Alzamora, Belleville, NJ (US); Adam Foltz, Budd Lake, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/161,773

(22) Filed: Aug. 16, 2005

(51) Int. Cl.
*F41C 27/00* (2006.01)
*G01B 21/16* (2006.01)

(52) U.S. Cl. ..... 42/108; 42/90; 33/506; D10/64

(58) Field of Classification Search ..... 42/87, 42/90, 108; 33/501.05, 501.45, 501.18, 506; 86/38; D10/64
See application file for complete search history.

(56) References Cited

U.S. PATENT DOCUMENTS 1,398,311 A * 11/1921 Bartholdy ..... 33/501.45
1,809,547 A * 6/1931 Briney ..... 33/501.45
2,514,956 A * 7/1950 Kuebler ..... 33/501.45
2,903,797 A * 9/1959 Porter ..... 33/501.45
3,105,401 A * 10/1963 Diamond ..... 81/124.7
3,939,590 A * 2/1976 Musgrave ..... 42/90
5,052,143 A * 10/1991 Ryan ..... 42/90
5,197,465 A * 3/1993 Montgomery ..... 33/501.45
5,417,003 A * 5/1995 Claveau ..... 42/90
6,176,031 B1 * 1/2001 Ramsey ..... 42/90
6,754,987 B1 * 6/2004 Cheng et al. ..... 42/87
6,886,267 B1 * 5/2005 Karwowski et al. ..... 33/613

* cited by examiner

*Primary Examiner*—Michael J. Carone
*Assistant Examiner*—Bret Hayes
(74) *Attorney, Agent, or Firm*—John F. Moran; Michael C. Sachs

(57) ABSTRACT

An apparatus for testing a clearance between feed lips of an ammunition magazine includes a generally T-shaped member including a support portion and a measuring portion that is generally perpendicular to the support portion; the measuring portion including first and second surfaces, the first surface having a width that is less than the clearance between the feed lips and the second surface having a width that is greater than the clearance between the feed lips.

3 Claims, 4 Drawing Sheets

MAGAZINE FEED LIPS GAUGE

STATEMENT OF GOVERNMENT INTEREST

The inventions described herein may be manufactured, used and licensed by or for the U.S. Government for U.S. Government purposes.

BACKGROUND OF THE INVENTION

The present invention relates in general to ammunition magazines and, in particular, to a test gauge for determining whether an ammunition magazine is operable.

Ammunition magazines, for example, a thirty round magazine, may include feed lips that aid in chambering rounds of ammunition into a firearm chamber. Known magazines have an undetermined life expectancy and very few preventative features exist to avoid issuing magazines that are prone to stoppage and/or malfunction. While the problem has existed for many years, it has become increasingly visible due to the massive deployment of soldiers into theater and the present backorder of new magazines. There is a demand for critical inspection methods for used magazines that will enable reissue without the risk of weapon stoppages. Many other critical elements of small caliber weapons are gauged on a regular basis to ensure reliability of the weapon and survivability of the soldier.

To determine if magazine feed lips are within operational tolerances, the known method is a visual inspection. Many times a magazine is discarded only after a history of malfunctions. This is unsatisfactory due to the large number of magazines in use that may be prone to malfunctions. Therefore, there is a need for a reliable method of testing the feed lips of an ammunition magazine to determine if the feed lips are within tolerance.

SUMMARY OF THE INVENTION

It is an object of the invention to provide an apparatus for determining if the feed lips of an ammunition magazine are within tolerances.

One aspect of the invention is an apparatus for testing the clearance between feed lips of an ammunition magazine, comprising a generally T-shaped member including a support portion and a measuring portion that is generally perpendicular to the support portion; the measuring portion including first and second surfaces, the first surface having a width that is less than the clearance between the feed lips and the second surface having a width that is greater than the clearance between the feed lips.

Another aspect of the invention is an apparatus for testing a clearance between feed lips of an ammunition magazine, the feed lips having a length and the magazine having a raised contour, comprising a generally T-shaped member including a support portion and a measuring portion that is generally perpendicular to the support portion, the support portion including channels on opposite sides configured to mate with the raised contour of the magazine; the measuring portion including first and second surfaces, the first surface having a width that is less than the clearance between the feed lips and the second surface having a width that is greater than the clearance between the feed lips.

A further aspect of the invention is an apparatus comprising an ammunition magazine comprising feed lips and a raised contour, the feed lips having a length and a clearance; a generally T-shaped member including a support portion and a measuring portion that is generally perpendicular to the support portion, the support portion including channels on opposite sides, one of the channels engaging the raised contour of the magazine; the measuring portion including first and second surfaces, the first surface having a width that is less than the clearance between the feed lips and the second surface having a width that is greater than the clearance between the feed lips.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The magazine feed lips gauge of the present invention is generally in the shape of a "T". The gauge may be machined in one piece from, for example, one-tool steel, type A2 or stainless steel. The material and method of construction should be similar to existing gauges such as the Firing Pin Protrusion Gauge used on the M16 and M4 Carbine. The magazine feed lips gauge is intended to check the minimum and maximum allowable clearance tolerances of magazine feed lips using a simple go, no-go concept.

Figure 1:
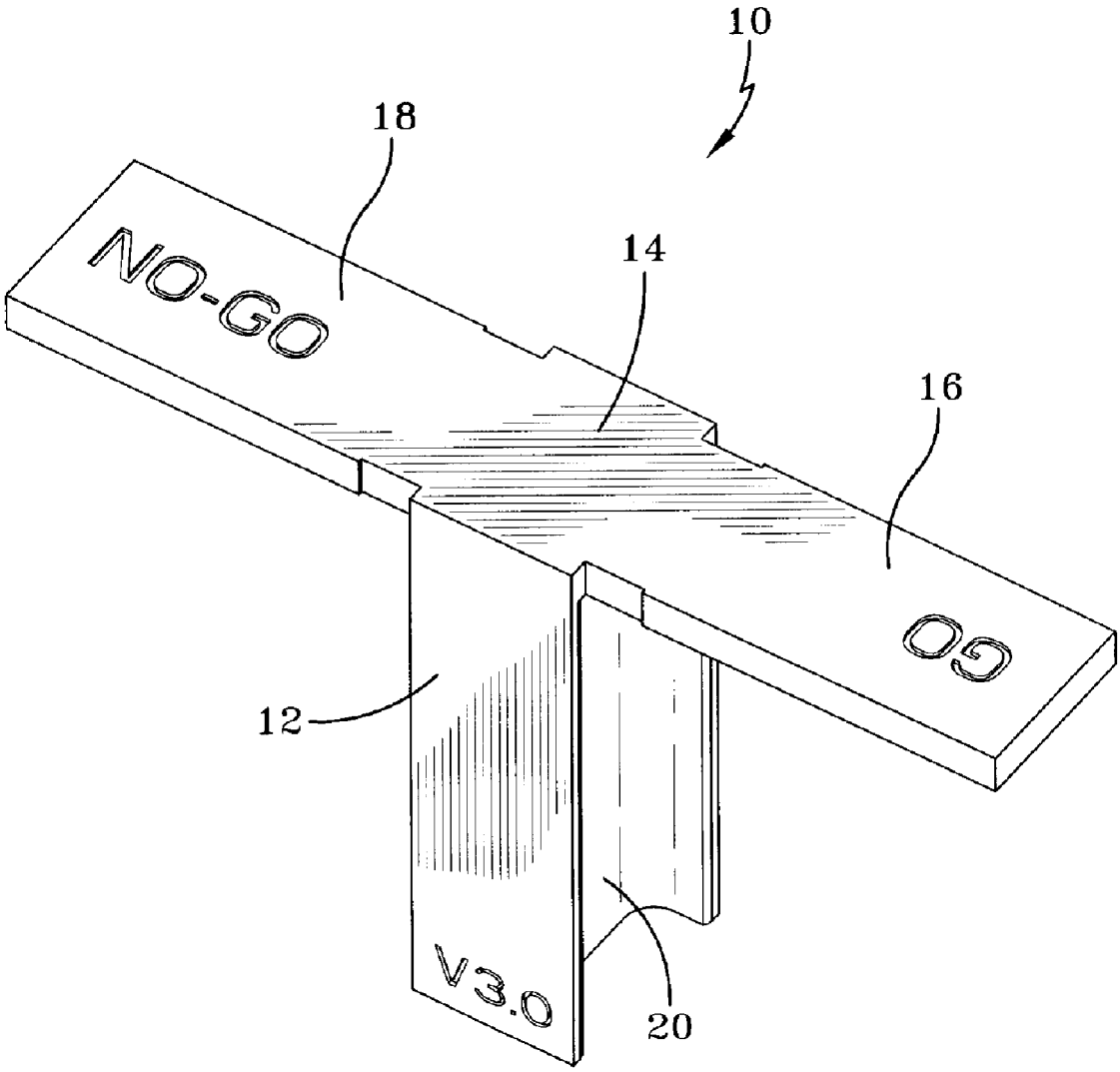
FIG. 1 is a perspective view of a gauge.
Figure 2C:
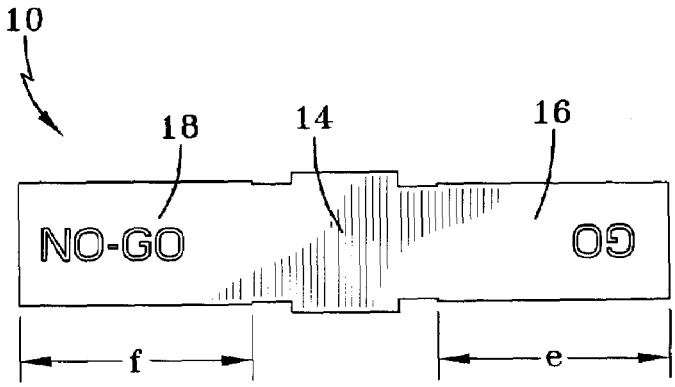
FIG. 2C is a top view of the gauge of FIG. 1.
Figure 2A:
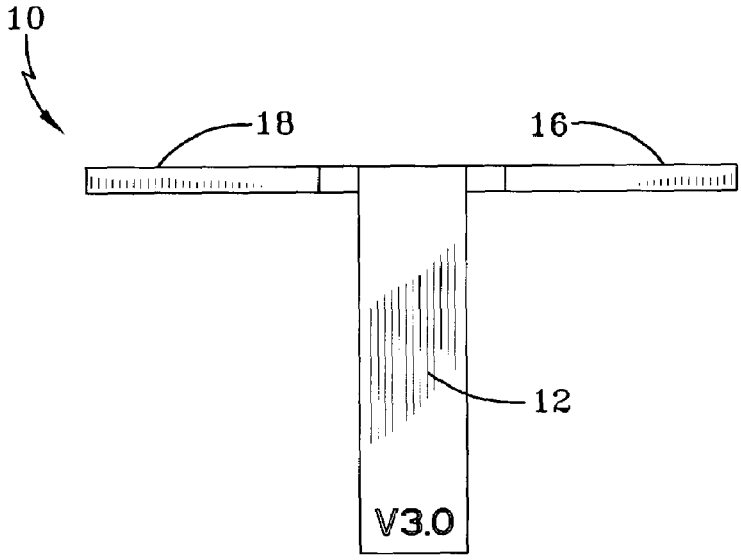
FIG. 2A is a front view of the gauge of FIG. 1.
Figure 2D:
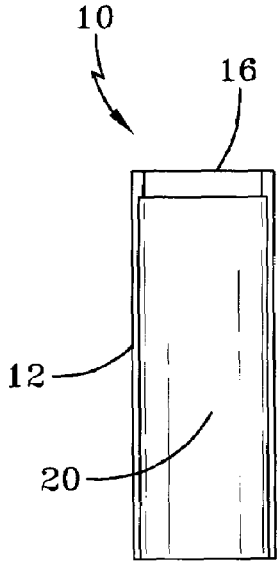
FIG. 2D is a side view of the gauge of FIG. 1.
Figure 2B:
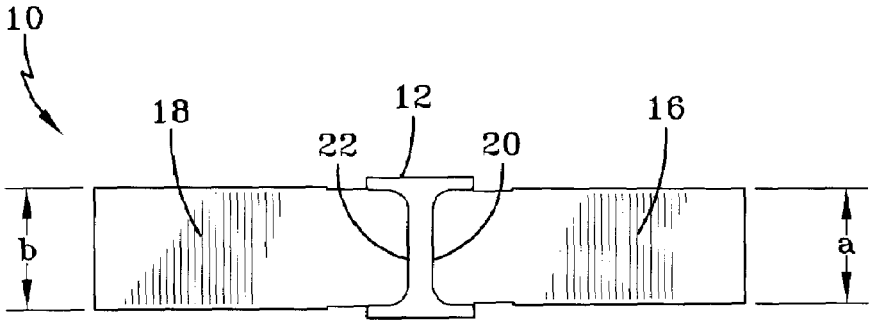
FIG. 2B is a bottom view of the gauge of FIG. 1.

FIG. 1 is a perspective view of a magazine feed lips gauge 10. FIG. 2A is a front view of the gauge 10 of FIG. 1. FIG. 2B is a bottom view of the gauge 10 of FIG. 1. FIG. 2C is a top view of the gauge 10 of FIG. 1. FIG. 2D is a side view of the gauge 10 of FIG. 1. Gauge 10 comprises a generally T-shaped member including a support portion 12 and a measuring portion 14 that is generally perpendicular to the support portion 12. The measuring portion 14 includes first and second surfaces 16, 18 on opposite ends of the measuring portion 14. The support portion 12 includes channels 20, 22 formed on opposite sides thereof. First surface 16 has a width a and a length e. Second surface 18 has a width b and a length f.

Figure 3B:
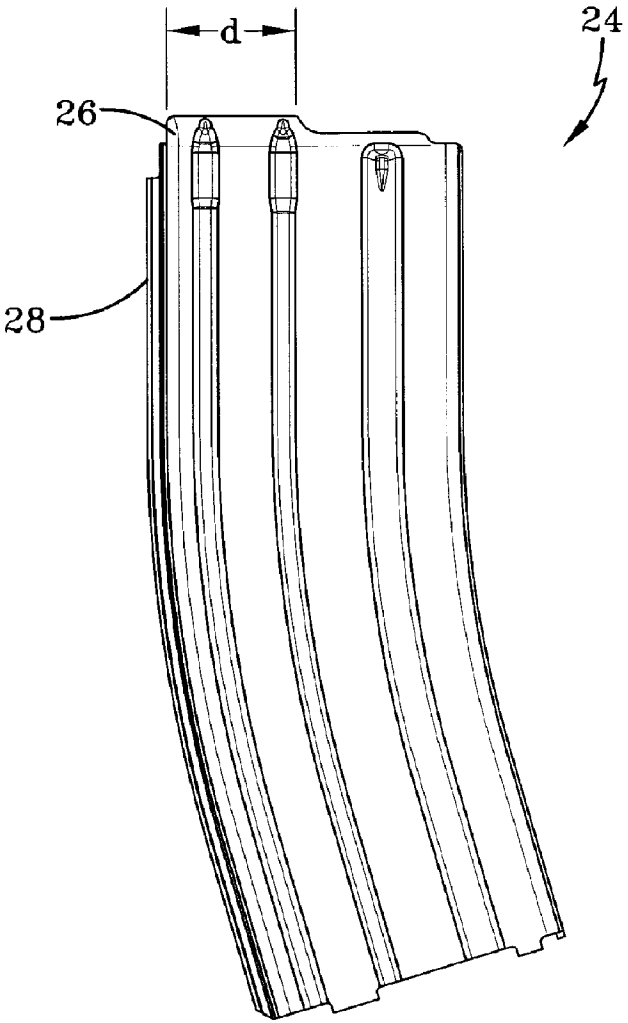
FIG. 3B is a side view of the magazine of FIG. 3A.
Figure 3C:
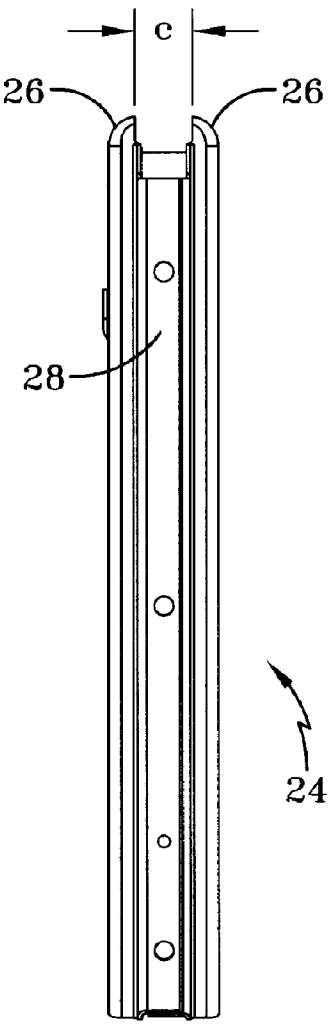
FIG. 3C is an end view of the magazine of FIG. 3A.
Figure 3A:
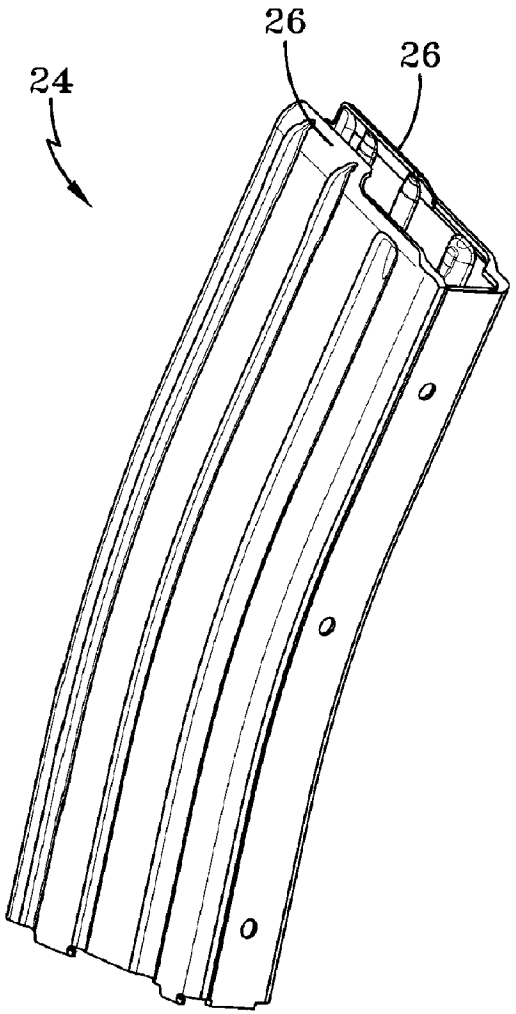
FIG. 3A is a perspective view of an ammunition magazine.

FIG. 3A is a perspective view of an ammunition magazine 24. FIG. 3B is a side view of the magazine 24 of FIG. 3A. FIG. 3C is an end view of the magazine 24 of FIG. 3A. Magazine 24 includes a pair of feed lips 26 having a length d. The design clearance c for the feed lips 26 is shown in FIG. 3C. Magazine 24 includes a raised contour 28 that runs longitudinally on one side of the magazine.

Channels 20, 22 of the support portion 12 of the gauge 10 are configured to mate with the raised contour 28 of the magazine 24. The width a of the first surface 16 of the measuring portion 14 is less than the design clearance c between the feed lips 26. The width b of the second surface

18 of the measuring portion 14 is greater than the design clearance c between the feed lips 26. The length e of the first surface 16 and the length f of the second surface 18 are at least as long as the length d of the feed lips 26.

Figure 4C:
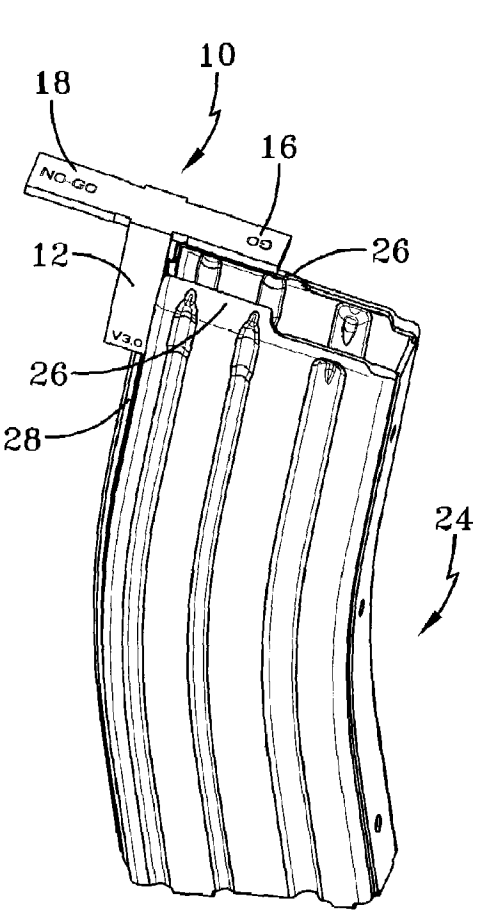
FIGS. 4A, 4B, and 4C are perspective views of the gauge of FIG. 1 engaging the magazine of FIG. 3A.
Figure 4B:
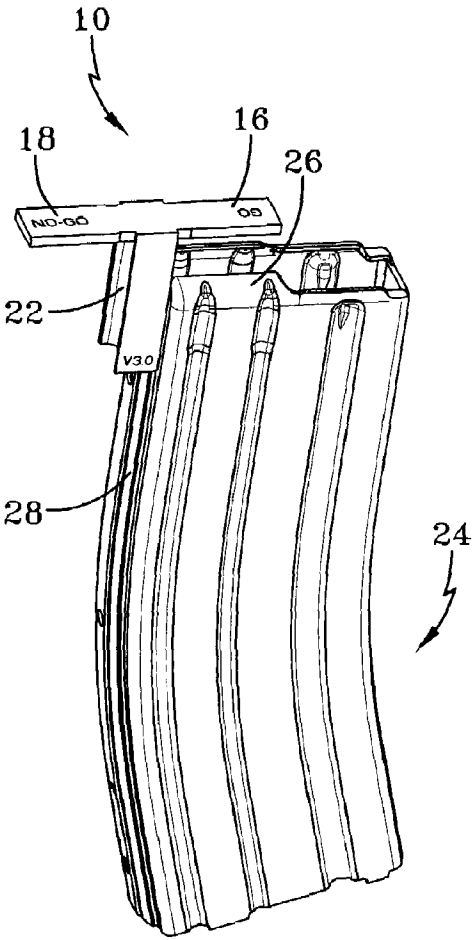
Figure 4A:
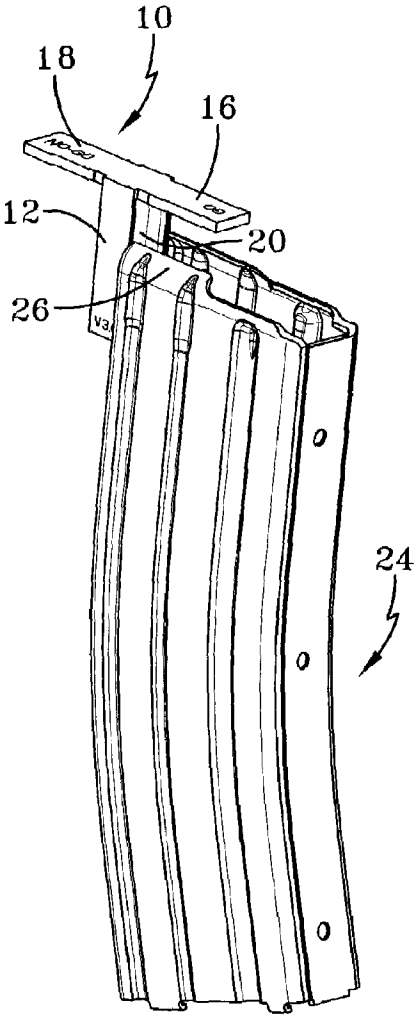

FIGS. 4A, 4B, and 4C are perspective views of the gauge 10 of FIG. 1 engaging the magazine 24 of FIG. 3A. To use the gauge 10, one of the channels 20, 22 (channel 20 in FIGS. 4A–C) is placed over the side of the magazine 24 closest to the feed lips 26 so that the first and second surfaces 16, 18 are parallel to the magazine width. The channel 20 fits over the raised welded magazine contour 28. The support portion 12 and the channel 20 are used as a sliding reference when initiating the gauge 10 into the clearance of the feed lips 26 from above.

Both channels 20, 22 are identical to thereby allow either the maximum or minimum tolerance to be evaluated by simply rotating the gauge 180 degrees. The first surface 16 (i.e., the minimum or GO side of the gauge) should slide down into the magazine 24 without coming into contact with the feed lips 26. The second surface 18 (i.e., the maximum or NO-GO side of the gauge) should be prevented from entering into the magazine by the feed lips 26. The widths and lengths of the first and second surfaces 16, 18 of the gauge 10 will vary depending on the particular magazine 24 being tested. The widths of the first and second surfaces 16, 18 are associated with the tolerances of the feed lips 26 referenced from datum planes included in the engineering drawings for a particular magazine 24.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus, comprising:

an ammunition magazine comprising feed lips and a raised contour, the feed lips having a length and a clearance;

a generally T-shaped member including a support portion and a measuring portion that is generally perpendicular to the support portion, the support portion including channels on opposite sides, one of the channels engaging the raised contour of the magazine;

the measuring portion including first and second upper arms on the generally T-shaped member, each upper arm having two opposite edges thereon, the first upper arm having a distance between its two edges that is less than the clearance between the feed lips and the second upper arm having a distance between its two edges that is greater than the clearance between the feed lips.

2. The apparatus of claim 1 wherein the first and second upper arms are on opposite ends of the measuring portion.

3. The apparatus of claim 2 wherein the first and second upper arms are at least as long as the length of the feed lips.

* * * * *